US007144192B2

(12) United States Patent
Holl et al.

(10) Patent No.: US 7,144,192 B2
(45) Date of Patent: Dec. 5, 2006

(54) SELF-PROPELLED ROAD MILLING MACHINE

(75) Inventors: Bernd Holl, Neustadt/Wied (DE); Herbert Ley, St. Katharinen (DE); Guenter Haehn, Koenigswinter (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/511,031

(22) PCT Filed: Apr. 30, 2003

(86) PCT No.: PCT/EP03/04517

§ 371 (c)(1),
(2), (4) Date: Oct. 13, 2004

(87) PCT Pub. No.: WO2004/005623

PCT Pub. Date: Jan. 15, 2004

(65) Prior Publication Data

US 2005/0158120 A1 Jul. 21, 2005

(30) Foreign Application Priority Data

Jul. 9, 2002 (DE) ..... 102 30 784
Jul. 18, 2002 (DE) ..... 102 32 489

(51) Int. Cl.
*E01C 23/16* (2006.01)

(52) U.S. Cl. ..... 404/93; 404/122; 404/124

(58) Field of Classification Search ..... 404/91, 404/94, 93, 122, 124; 239/146, 156; 299/39.4
See application file for complete search history.

(56) References Cited

U.S. PATENT DOCUMENTS

| | | | | |
|---|---|---|---|---|
| 3,072,391 | A * | 1/1963 | McDarrah | 299/37.3 |
| 4,614,379 | A * | 9/1986 | Wirtgen | 299/39.8 |
| 4,704,045 | A | 11/1987 | Taylor et al. | |
| 4,720,207 | A | 1/1988 | Salani | |
| 4,852,946 | A * | 8/1989 | Hackmack | 299/10 |
| 5,395,417 | A * | 3/1995 | Thomas | 71/5 |
| 5,505,598 | A | 4/1996 | Murray | |
| 5,722,789 | A * | 3/1998 | Murray et al. | 404/90 |
| 5,893,677 | A * | 4/1999 | Haehn et al. | 404/90 |
| 6,210,071 | B1 * | 4/2001 | McSharry | 404/94 |
| 6,547,484 | B1 * | 4/2003 | Murphy | 404/124 |
| 6,877,818 | B1 * | 4/2005 | Gaertner et al. | 299/39.8 |

FOREIGN PATENT DOCUMENTS

WO WO 01/04422 A1 1/2001

* cited by examiner

*Primary Examiner*—Addie W. Raymond
(74) *Attorney, Agent, or Firm*—Diller, Ramik & Wight

(57) ABSTRACT

A self-propelled road milling machine includes a chassis (2) housing a rotatable milling roll (4) between lateral plates (12,13) disposed orthogonal to the axis of the milling roll (4). The milling roll (4) has a base body (14) and a milling tube (10), and is driven by a drive device (6) mounted on an exterior of an input-side of the lateral plate (12) by a reduction gear unit (8). The lateral plate (13) provides for exchanging alternatively mountable milling tubes (10) of different milling widths by being easily detached. For milling near an edge, a reduction gear unit (8) is mounted on the input side, and the reduction gear unit (8) is mounted on the interior of the input-side lateral plate (12) whose outer surface (25) forms a seat for milling tube elements that can be slid thereon from a non-driven side.

14 Claims, 5 Drawing Sheets

SELF-PROPELLED ROAD MILLING MACHINE

The invention relates to a self-propelled road milling machine.

BACKGROUND OF THE INVENTION

Due to different construction site situations and milling works, it is often necessary to adapt the milling tool of a road milling machine to the specific tasks. If, for example, a specific surface roughness shall be achieved, a milling roll with a specific track distance of the milling tools or another tool equipment is required. In another application, only certain roadway widths shall be completed so that a milling roll with a specific working width is required.

Typically, a special milling machine has to be used in such situations or the machine has to be fitted with a milling roll adapted to the task. At present, however, exchanging the milling rolls is very troublesome and requires special auxiliaries for respectively mounting and dismounting the milling roll.

In prior art, it is known to adapt the milling tool to different requirements.

In U.S. Pat. No. 4,704,045, a milling aggregate is described the width of which can be varied by using different roll segments. In this solution, the roll segments are connected with each other via a plug-in connection. Although, in a certain way, this type represents a milling roll quick change system, it has the following disadvantages:

This solution is disadvantageous in that the milling roll drive is effected hydrostatically by arranging hydraulic motors at both sides of the milling roll. Moreover, the connection between the segments is a simple plug-in connection that only permits an insufficient centering of the milling rotor. Because a drive device is provided at both sides, it is not possible to mill near the edges. Moreover, a roll housing of variable width is required the construction of which is very complicated.

U.S. Pat. No. 4,720,207 describes milling tube segments mounted on a roll base body. In this concept, a side ring segment is attached at one side first. Then, the milling tube segments are screwed down thereon, the screw connections being located within the segments. The enormous screwing efforts and the fact that the milling depth is restricted because of the constant diameter of the base body when a planet gear is integrated in the base body are disadvantageous.

U.S. Pat. No. 5,505,598 describes another solution where, above all, the milling depth is not restricted. The reduction gear unit of this milling roll is located on the side opposite to the driven pulley and is driven by a drive shaft led through the milling roll axis.

This gear arrangement with a gear unit the outer diameter of which is only slightly smaller than that of the milling tube is required to permit a flush milling. From the section of the milling roll in which the reduction gear unit is integrated, an axle stub projects on which further segments with milling tools can be mounted.

This solution is disadvantageous in that the milling roll has to be completely dismounted to carry out different milling operations such as standard or fine milling. In an application with maximum working width, i.e., when all segments are mounted, the individual segments have different cutting circle diameters so that the road surface milled therewith is milled in a stepped manner in transverse direction.

The three last-mentioned solutions also have the disadvantage that the segmented milling tubes are subject to different wear since not all milling tube segments are always used.

From the generic WO 01/04422, a road milling machine with a machine chassis is known in which a milling roll is rotatably supported, the milling roll comprising a roll base body driven by a milling roll drive means via a gear unit and alternatively employable coaxial milling tubes adapted to be slid onto the roll base body from one side and being exchangeably mounted and carrying cutting tools on their outer shell surface.

In the known self-propelled road milling machine, the reduction gear unit is provided at the input side if the milling tubes extend over the entire working width. The roll base body is mounted to a radially projecting flange of the gear housing, a screw connection from the difficultly accessible input side being required. The known solution with the arrangement of the reduction gear unit on the input side cannot be employed in a sensible manner for milling tubes of a smaller milling width since the milling depth is limited for the following reasons:

The milling tubes almost have to be flush with the null side to permit a milling near the edge. The gear unit arranged on the input side would limit the realizable milling depth.

In case of milling tubes that do not extend over the entire working width, the reduction gear unit is therefore arranged on the null side of the machine, i.e., on the side where a milling near the edge is possible. This has the disadvantage that a drive shaft extending from the input side to the reduction gear unit on the null side is required, which has to be supported and provided with an additional protection tube as protection against damage. The reduction gear unit forms a stationary bearing, which, because of the arrangement on the null side, inevitably requires that a movable bearing be arranged on the input side. This is disadvantageous in that a pivotable lateral plate for the quick exchange of the milling tubes is arranged on the null side, which is less suitable for receiving the high reaction forces of a stationary bearing in axial direction. In this solution, the movable bearing is further located on the difficultly accessible input side on which, e.g., the torsion protection for the movable bearing must be mountable. Another disadvantage consists in that the long drive shaft acts like a torsional spring system whereby a rigid drive of the milling roll is not possible and the maximally possible cutting forces are reduced.

For supporting the milling tubes on the roll base body, split rings are absolutely necessary, which have to be mounted in a constrained position of the fitter. The mounting of the split rings may require to repeatedly change the rotational position of the roll base body, e.g., by 180, whereby the risks of an accident are increased.

SUMMARY OF THE INVENTION

It is the object of the invention to provide a self-propelled road milling machine wherein the change of milling tubes of different milling widths is simplified and the time required therefor and the labor consumption is minimized.

The invention advantageously provides that the reduction gear unit is mounted at the input side, that the reduction gear unit comprises an output element which is mounted on the interior of the input-side lateral plate and whose shell surface forms a seat for milling tube elements that can be slid thereon from the null side, i.e., namely the input-side ends of the milling tubes or radial supporting means for the milling tubes and/or tubular protection means for the output element, and that the roll base body is coupled to the reduction gear unit at the free face of the output element without hindering the milling tube elements in being slid on.

According to the invention, the reduction gear unit is arranged on the input side, the reduction gear unit comprising a preferably circularly cylindrical housing forming the output element of the reduction gear unit, the roll base body being coupled to the reduction gear unit at the face of the housing. Thus, it is possible to slid milling tubes of different milling widths up to the maximum milling width onto the roll base body and/or the housing always from the null side, a mounting being exclusively possible from the null side. The housing has a cross-sectional shape permitting the milling tube or supporting means for the milling tube and/or protection means for the housing to be slid on from the null side, the inner contour of the supporting means or the protection means matching the cross-sectional shape of the housing. In this respect, the housing forms a seat for milling tube ends, supporting and/or protection means being adapted to be slid on from the null side. To this end, the roll base body has a maximum outer diameter that is not greater than the outer diameter of the housing. No split rings for supporting the milling tubes are required which rings, according to prior art, have to be mounted in a constrained position. Coupling the roll base body at the face of the housing advantageously increases the realizable milling depth. The one-piece supporting rings according to the invention are adapted to be easily slid onto the housing of the reduction gear unit from the null side and there, they can be fixed at any place in a manner comfortable to the fitter.

This considerably simplifies the mounting efforts and the time required therefor. Moreover, the risks of an accident are minimized because no mounting operations have to be carried out on the difficultly accessible input side and a rotation of the milling roll is not required.

The circularly cylindrical housing of the reduction gear unit whose cross-sectional shape matches the supporting means for the milling tube is able to receive tubular or annular undivided radial supporting means for the milling tube and/or protection means for the housing on its entire axial length. Of course, the seat for the supporting and/or protection means may also extend over a part of the axial length of the preferably circularly cylindrical housing only.

It is particularly provided that the radial supporting means form a movable bearing for the milling tube on the preferably circularly cylindrical housing. The tubular or annular radial supporting means positively encompass the preferably circularly cylindrical housing. In doing so, the milling tubes are advantageously centered automatically so that the danger of balance errors is minimized. The movable bearing may either be formed between the milling tube and the radial supporting means, e.g., a radial supporting ring, or, if the radial supporting ring is mounted to the milling tube, it may be formed between the radial supporting ring and the seat on the shell surface of the housing. In this case, the radial supporting ring and a protection tube possibly mounted at the radial supporting ring may slide on the seat surface, namely the shell surface of the housing of the reduction gear unit.

At the face of the housing, a centering means for the roll base body may be arranged. The centering means consists, for example, of a centering projection either supported on the inner shell surface of the tubular roll base body or is preferably adapted to the inner diameter of a connection flange of the roll base body.

In preferred embodiments, it is provided that the free end of the roll base body is unilaterally supported in the easily dismountable lateral plate opposite to the input-side lateral plate. In this case, the bearing of the roll base body provided on the null side is a movable bearing while a stationary bearing is formed by the reduction gear unit at the input side. The advantage consists in that the stationary bearing receiving axial forces is arranged at the rigid input side where the lateral plate can receive higher reaction forces, particularly higher axial reaction forces.

At the radial supporting means for the milling tube, a protection tube covering the reduction gear unit can be fastened to protect the housing from damage.

In a development of the invention, it is provided that the reduction gear unit comprises at least one reduction stage in an input-side gear unit portion at the site of coupling with the drive means and at least one further reduction stage in the interior of the milling tube in a milling roll-side gear unit portion.

The division of the reduction gear unit into an input-side gear unit portion at the coupling site of the drive means and a further gear unit portion arranged within the milling roll permits the reduction of the diameter of the cylindrical housing element, whereby a greater milling depth can be achieved with milling tubes of shorter structural length.

Preferably, it is provided that the at least one input-side reduction gear unit stage is arranged so as to be axially offset with respect to the at least one milling roll-side reduction stage.

The gear unit portions are arranged on both sides of the input-side lateral plate. The two gear unit portions are coupled with each other via a gear shaft passing through the lateral plate.

The easily dismountable lateral plate provided on the null side can be configured so as to be pivotable to exchange the milling tubes.

The preferably circularly cylindrical housing has an outer diameter of maximally 400 mm, preferably of maximally 350 mm.

In a preferred embodiment, it is provided that the roll base body comprises a first face-side annular flange adapted to be axially coupled at the face of the housing from the null side as well as a second annular flange radially seated on the roll base body so as to rotate therewith and being adapted to be axially coupled with an annular flange projecting radially inward from the milling tube. The torque outputted from the housing of the reduction gear unit as the output element is transferred onto the milling tube by means of the annular flange of the roll base body and the radial annular flange of the milling tube.

Hereinafter, embodiments of the invention are explained in detail with reference to the drawings.

In the Figures:

DETAILED DESCRIPTION OF THE PREFERRED EMBODIMENTS

Figure 1:
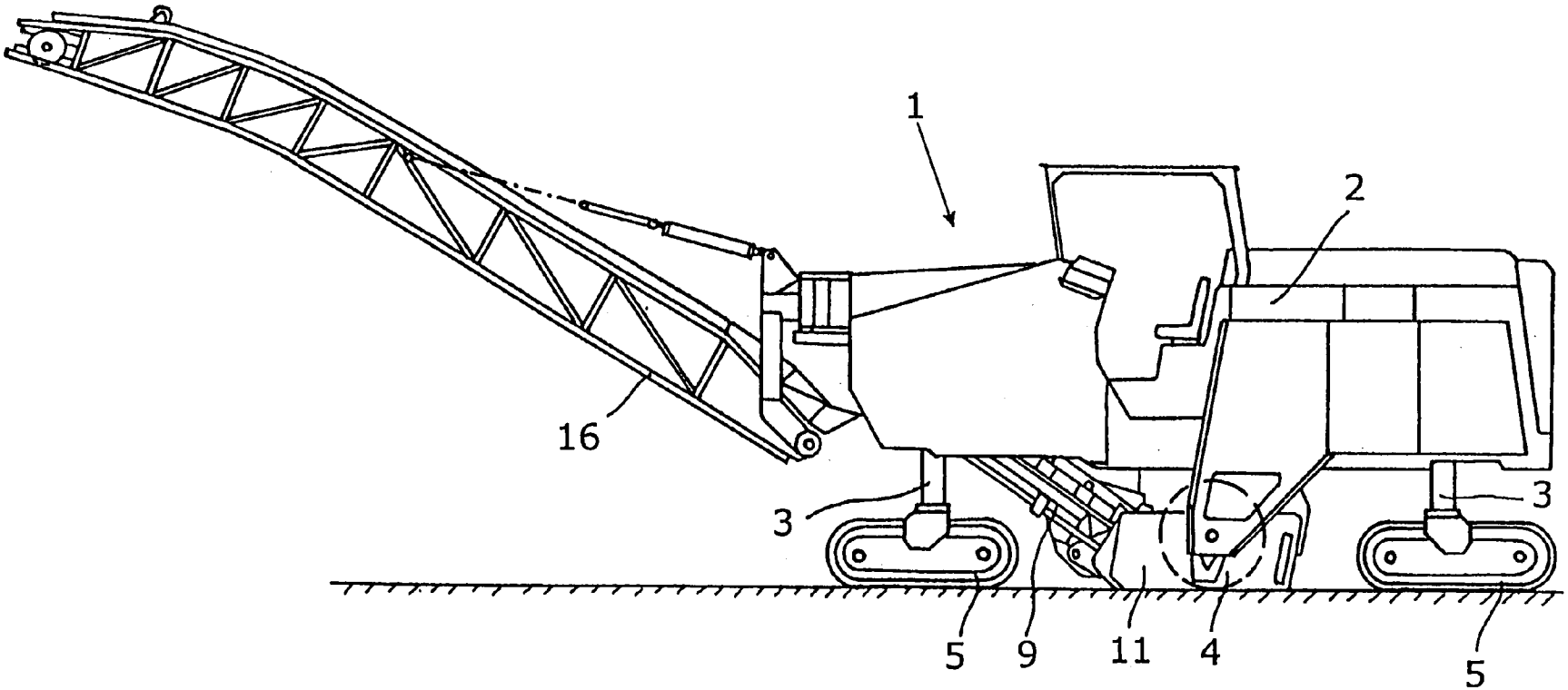
FIG. 1 shows a self-propelled road milling machine.

In FIG. 1, a road milling machine 1 is illustrated in which the quick change milling tube system described hereinafter can be employed. Generally, road milling machines consist of a machine chassis 2 on which an internal combustion engine and a driver's stand are mounted. The self-propelled road milling machine comprises height-adjustable lifting columns 3 mounted to the machine chassis 2, on which supporting wheels or a chain running gear 5 is mounted.

The milling roll 4 is located beneath the machine chassis 2 in a roll box 11 laterally limited by the lateral plates 12,13. In a manner known per se, the material machined off by the milling roll 4 is dropped on a first conveyor belt 9 and transported on onto a second height-adjustable and pivotable conveyor belt 16.

A milling roll 4 is supported rotatably between lateral plates 12,13 of the roll box 11, which extend orthogonally to the axis of the milling roll and are driven via a drive means 6 supported on the input-side lateral plate 12 and a reduction gear unit 8.

The milling roll 4 consists of a roll base body 14 coupled to a housing 26 of the reduction gear unit 8 arranged at the input-side lateral plate 12 and an integral milling tube 10 being exchangeably mounted at the roll base body 14. The roll base body 14 is arranged axially beside the reduction gear unit portion 8*b*. The roll base body 14 transfers the torque of the reduction gear unit 8 to the respectively used milling tube 10. Alternatively useable milling tubes 10 of different milling widths and different tool equipment are available for different road machining procedures and are adapted to be quickly changed.

Figure 2:
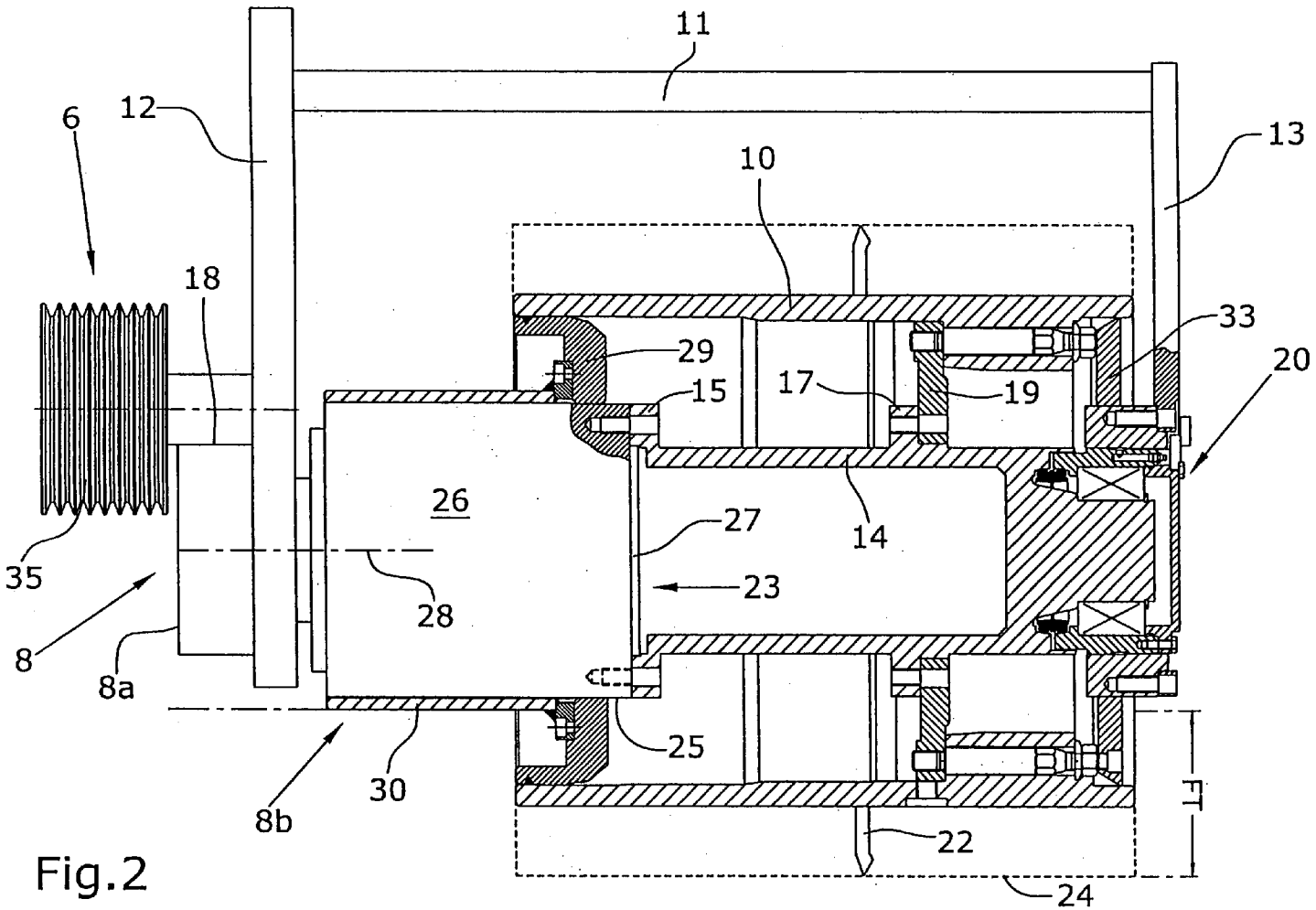
FIGS. 2 to 5 show embodiments of the invention with milling tubes of different milling widths.

FIG. 2 shows a first embodiment wherein the drive means 6 is arranged at the input-side lateral plate 12 of which only the pulley 35 is shown in FIG. 2. The combustion engine drives this pulley 35 via, e.g., a joined V-belt. At a coupling site 18, the pulley 35 is directly coupled with a first reduction stage of the reduction gear unit 8 in an input-side gear unit portion 8*a*. Another reduction stage is coupled with the first reduction stage via a gear shaft 28. The second reduction gear unit stage is arranged at a preferably circularly cylindrical housing 26 that is arranged at the milling roll side at the input-side lateral plate 12. The housing 26 forms the output element of the reduction gear unit 8.

At the face 23 of the circularly cylindrical housing 26, a roll base body 14 is mounted coaxially to the housing 26 by means of an annular flange 15 provided at the face of the roll base body, the free end of the roll base body 14 being supported in a movable bearing in the lateral plate 13 opposite to the input-side lateral plate 12. The lateral plate 13 is arranged on the null side of the road milling machine which characterizes that side where milling near the edge is possible. At the null side, the distance from the face-side edge of the milling roll 4 to the outside wall of the road milling machine 1, e.g., the lateral plate 13, is kept as small as possible.

At maximum, the annular flange 15 of the roll base body 14 has the same outer diameter as the cylindrical housing 26, the inner diameter of the annular flange 15 being seated on a cylindrical centering projection 27 of the housing 26 so that an exactly coaxially oriented position of the roll base body 14 to the reduction gear unit 8 is ensured. At a distance from the annular flange 15 as well as at a distance from the lateral plate 13, a second annular flange 17 is provided on the roll base body 14 and serves as a fastening means for the milling tubes 10. To this end, annular flanges 19 or other fastening means project radially inward from the inside of the milling tubes 10 and cooperate with the annular flange 17. The annular flange 17 transfers the torque of the roll base body 14 to the milling tube 10.

The milling tube 10 is fitted with milling tools 22, for example, the tool engagement circle 24 of which is indicated by the dashed line in the Figs. The maximum milling depth FT is indicated by another dashed line below the lateral plates 12,13.

Preferably, the easily dismountable lateral plate 13 is pivotable but, as an alternative, it may also be axially removable.

The milling tube shown in FIG. 2 has a milling width of 750 mm, for example. The free end of the milling tube 10 facing the input side is supported on a supporting ring 29 which is pushed on the housing 26 and fastened there. From this radial supporting ring 29, a protection tube 30 mounted to the supporting ring 29 projects, which coaxially surrounds the circularly cylindrical housing 26 and protects the housing 26 of the reduction gear unit 8 from damage. Between the radial supporting ring 29 and the milling tube 10, a movable bearing is formed, the milling tube 10 being able to slide on the supporting ring 29.

Alternatively, the radial supporting ring 29 and the protection tube 30 can be mounted to the milling tube 10, the common construction of the supporting ring 29 and the protection tube 30 being able to seat on the housing 26 and slide, in the manner of a movable bearing, on the seat of the shell surface 25 of the housing 26 extending in parallel to the gear shaft 28.

In the embodiments of FIGS. 2 to 5, the roll base body 14 is pre-assembled with the housing 26 of the reduction gear unit 8 and the annular flange 19. If a change of the milling tube 10 is required because of another task during milling, this change can be effected quickly by dismounting or pivoting the lateral plate 13 first. Then, the screw connections between the milling tube and the annular flange 19 have to be removed whereafter the entire milling tube can be pulled off from the null side. Subsequently, the radial supporting ring 29 along with the supporting tube 30 mounted thereto is pulled off its seat on the housing 26. They may remain on the housing if the milling tube is only changed for reasons of wear and an equivalent or a different milling tube of the same milling width, e.g., for fine milling, is pushed on again.

Figure 3:
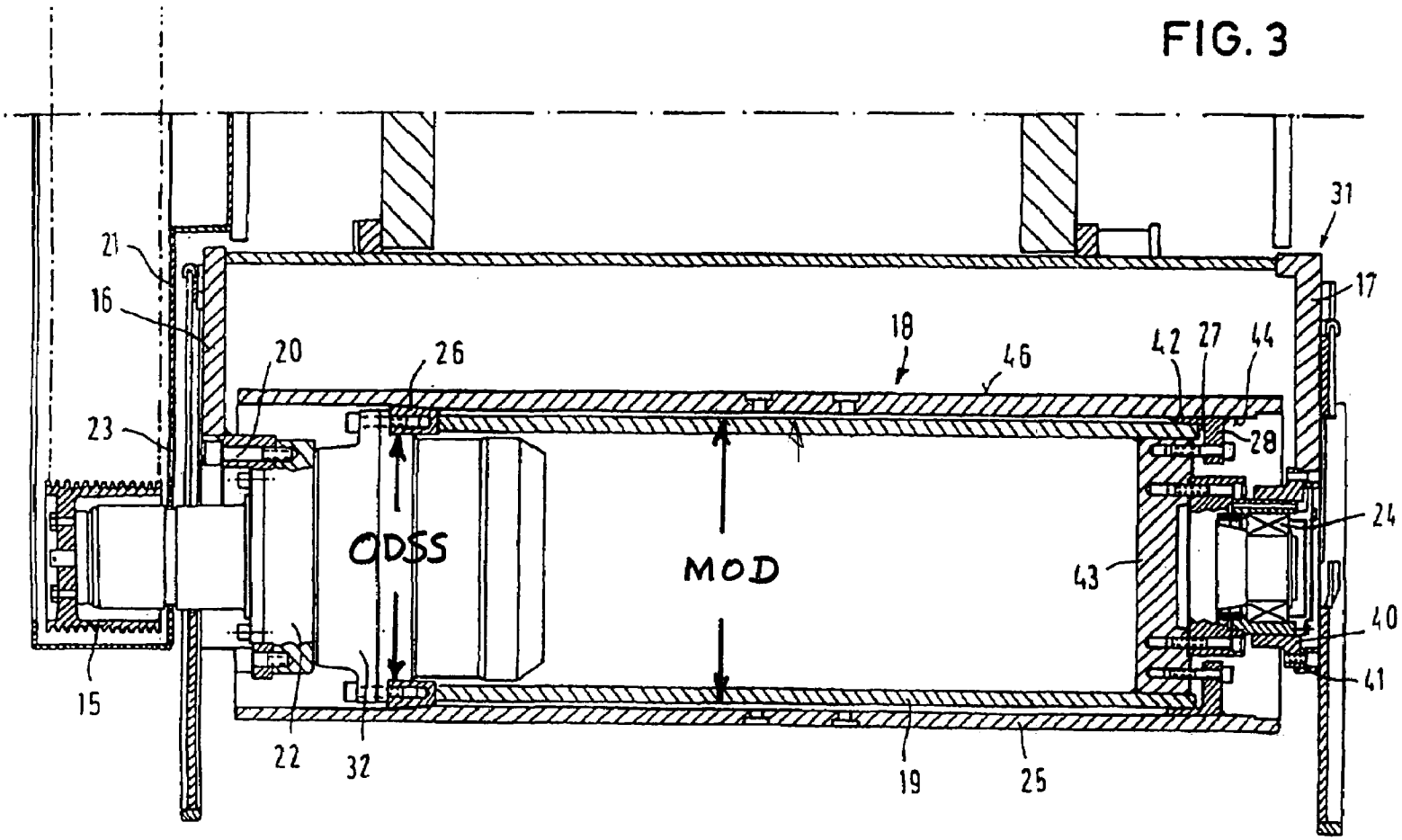

In the embodiments of FIGS. 2 and 3, the assembly is effected in reversed order. Accordingly, the supporting ring 29 with the protection tube 30 mounted thereto is first pushed onto the seat on the shell surface 25 of the housing 26 and fixed there. Subsequently, the milling tube 10 can be pushed onto the roll base body 14 and the radial supporting ring 29.

Then, the milling tube 10 is screw-connected with the annular flange 19, wherein it is possible to arrange another annular flange 33 as a face-side cover plate at the end of the milling tube 10 facing the null side in order to prevent dirt from entering into the interior of the milling tube 10 at the face-side end of the milling tube 10.

The supporting ring 29 may also be integral with the milling tube 10, the milling tube 10, together with the supporting ring 29, being pushed onto the roll base body 14. In principle, the annular flange 19 may also be integral with the milling tube 10.

The embodiment of FIG. 3 largely corresponds to the embodiment of FIG. 2, the milling tube 10 having a maximum milling width between the lateral plates 12,13. The radially supporting annular flange 29 is supported on the input-side end of the housing 26. The protection tube 30 mounted to the annular flange 29 is shortened and ends at the face-side end of the housing 26 which faces the input side.

In the embodiments of FIGS. 2 and 3, it may alternatively be provided that the annular flange 29, along with the protection tube 30, is mounted to the milling tube 10 and pushed onto the shell surface 25 of the housing 26 along with said milling tube.

Figure 4:
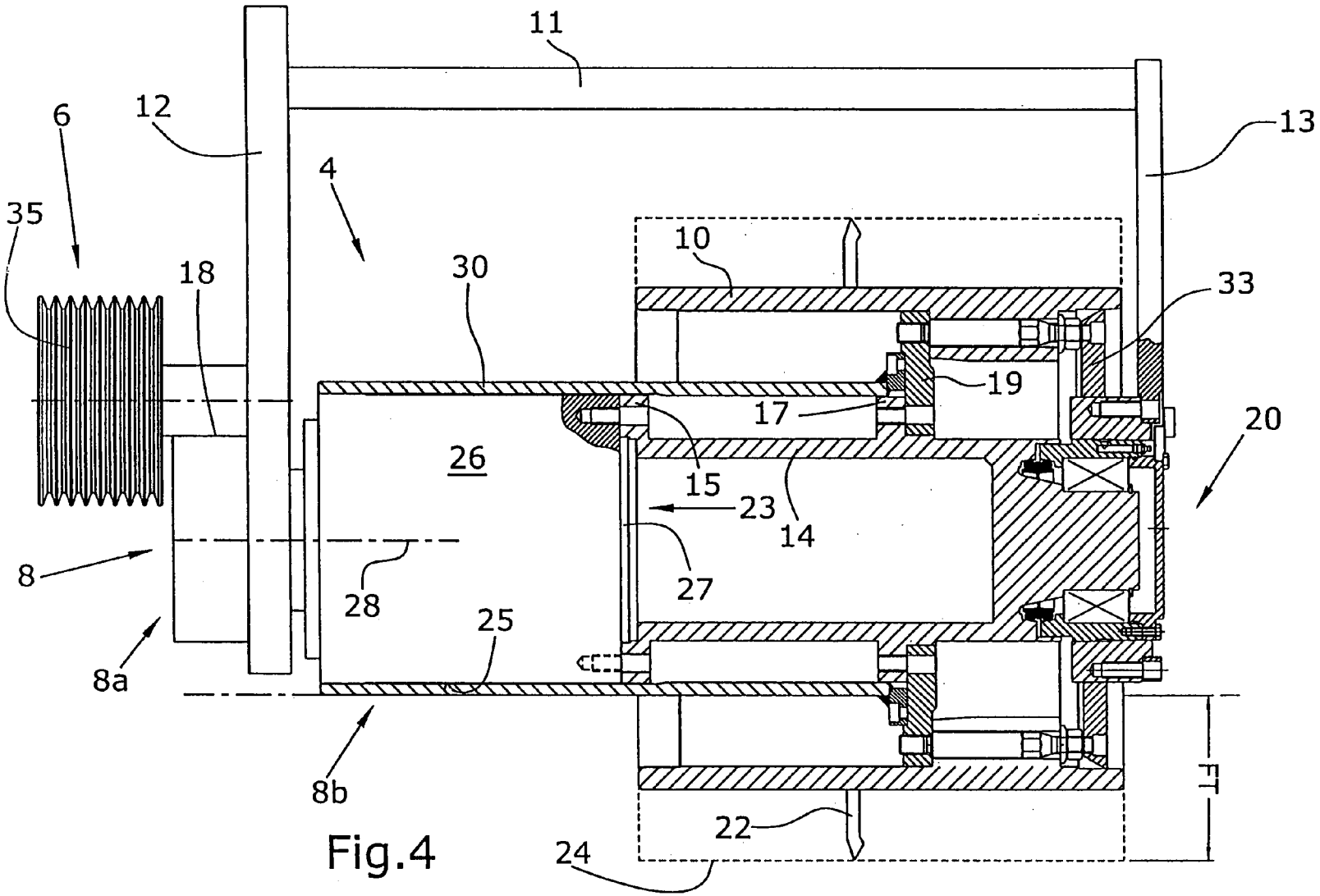

In the embodiment of FIG. 4, the milling tube 10 is even shorter than in the embodiment of FIG. 2 so that a second radial support of the milling tube 10 may be omitted. In this case, the protection tube 30 is mounted at the annular flange 19 of the milling tube 10. During the assembly, the milling tube 10 is pushed onto the seat on the shell surface 25 of the housing 26 together with the protection tube 30. In the embodiments of FIGS. 2 to 5, both the reduction gear unit and the roll base body 14 may remain unchanged when the milling width is changed, whereas the milling tubes can be mounted or dismounted axially from the null side. No access from the input side is required.

Figure 5:
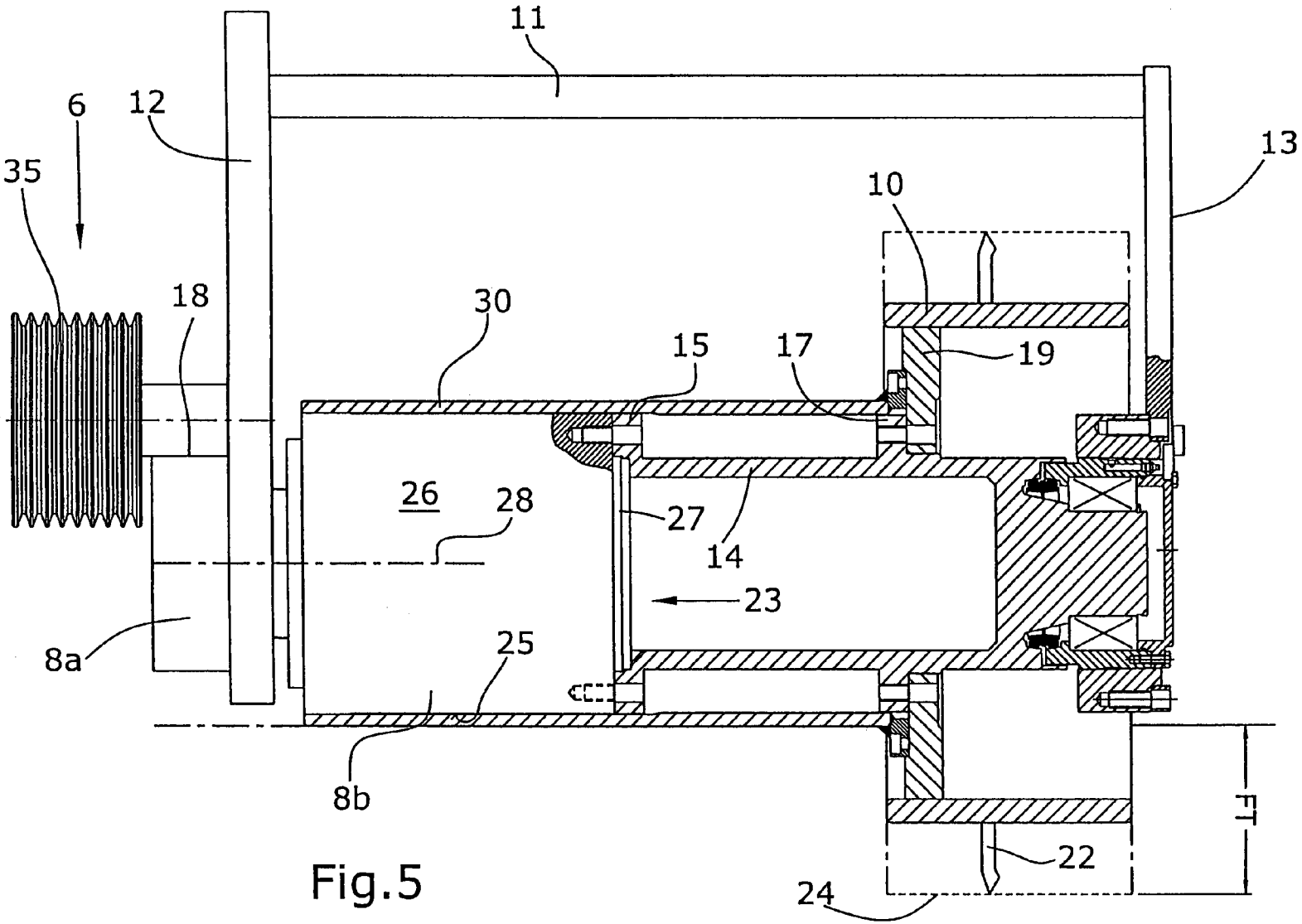

The embodiment of FIG. 5 shows a milling tube with short milling width which is only screw-connected with the roll base body 14 via the annular flange 19.

It is particularly advantageous that only the milling tube 10 has to be exchanged in the respective embodiments of FIGS. 2 to 5. The reduction gear unit 8 and the roll base body remain unchanged relative to the drive means so that no adjustment of the drive train is required. By its seat on the roll base body 14 and/or on the cylindrical housing 26, the milling tube 10 is automatically centered whereby balance errors are avoided in particular. The easily removable fastening means of the milling tube 10 are protected from soiling and damage.

Although a preferred embodiment of the invention has been specifically illustrated and described herein, it is to be understood that minor variations may be made in the apparatus without departing from the spirit and scope of the invention, as defined by the appended claims.

The invention claimed is:

1. A self-propelled road milling machine comprising a machine chassis (2) including spaced drive input side and null side lateral plates (12, 13, respectively), a milling roll (4) mounted for rotation between said lateral plates (12, 13), said milling roll (4) including a roll base body (14) in internal coaxial relationship to a milling tube (10), drive means (6) supported upon said drive input side lateral plate (12) for imparting rotation to said milling roll (4) through a reduction gear unit (8), means for easily detaching said null side lateral plate (13) relative to said chassis (2) for exchanging milling tubes of different widths, said milling tubes (10) having means (29, 30) for mounting the drive input side of the milling tube (10) upon said reduction gear unit drive output portion (8*b*), said reduction gear unit (8) being located at a drive input side of said milling roll (4), said reduction gear unit (8) including a reduction gear unit drive output portion (8*b*) inboard and adjacent said drive input side lateral plate (12), said reduction gear unit drive output portion (8*b*) having an exterior radially supporting shell surface (25) corresponding substantially in size to an interior radial surface of said means (29, 30) for mounting the drive input side of the milling tube (10) upon said reduction gear unit drive output portion (8*b*), said radially supporting shell surface (25) of said drive output portion (8*b*) forming an axially extending seat for said mounting means (29, 30), said reduction gear unit drive output portion (8*b*) having a terminal end portion (23), means (15) for connecting said reduction gear unit drive output portion terminal end portion (23) to said roll base body (14), and said roller base body (14) having a maximum outer diameter that is not greater than the outer diameter of said shell surface (25) thereby not hindering slidable replacement of milling tubes (10) from a null side of said milling machine onto said radially supporting shell surface (25) of said drive output portion (8*b*) forming a seat for said mounting means (29, 30).

2. The self-propelled road milling machine as defined in claim 1 including protection means (30) for substantially completely covering and protecting said radially supporting shell surface.

3. The self-propelled road milling machine as defined in claim 1 wherein said radially supporting shell surface is of a circular cylindrical cross-sectional shape.

4. The self-propelled road milling machine as defined in claim 1 including means (27) defined by said reduction gear unit drive output portion for centering the roll base body relative to a milling tube upon relative telescopic assembling movement therebetween.

5. The self-propelled road milling machine as defined in claim 1 including protection means (30) for substantially completely covering and protecting said radially supporting shell surface, and said protection means (30) is a tube carried by radial supporting means (29) located between said milling tube (19) and said radially supporting shell surface.

6. The self-propelled road milling machine as defined in claim 1 wherein said roll base body (14) includes an annular flange in axial face-to-face abutting relationship with said reduction gear unit output portion terminal end portion.

7. The self-propelled road milling machine as defined in claim 1 wherein said roll base body (14) includes an annular flange in axial face-to-face abutting relationship with said reduction gear unit output portion terminal end portion, and said roll base body (14) including a further annular flange (17) radially seated on the roll base body for rotation therewith.

8. The self-propelled road milling machine as defined in claim 1 wherein said roll base body (14) includes an annular flange in axial face-to-face abutting relationship with said reduction gear unit output portion terminal end portion, said roll base body (14) including a further annular flange (17) radially seated on the roll base body for rotation therewith, and means (19) projecting inwardly from the milling tube which is connected to said further annular flange.

9. The self-propelled road milling machine as defined in claim 1 including protection means (30) for substantially completely covering and protecting said radially supporting shell surface, said protection means (30) is a tube carried by radial supporting means (29) located between said milling tube (19) and said exterior supporting shell surface, and said radial supporting means (29) is a ring.

10. The self-propelled road milling machine as defined in claim 2 including means (27) defined by said reduction gear unit drive output portion for centering the roll base body relative to a milling tube upon relative telescopic assembling movement therebetween.

11. The self-propelled road milling machine as defined in claim 2 including protection means (30) for substantially completely covering and protecting said radially supporting shell surface, and said protection means (30) is a tube carried by radial supporting means (29) located between said milling tube (19) and said radially supporting shell surface.

12. The self-propelled road milling machine as defined in claim 2 wherein said roll base body (14) includes an annular flange in axial face-to-face abutting relationship with said reduction gear unit output portion terminal end portion.

13. The self-propelled road milling machine as defined in claim 2 wherein said roll base body (14) includes an annular flange in axial face-to-face abutting relationship with said reduction gear unit output portion terminal end portion, and said roll base body (14) including a further annular flange (17) radially seated on the roll base body for rotation therewith.

14. The self-propelled road milling machine as defined in claim 2 wherein said roll base body (14) includes an annular flange in axial face-to-face abutting relationship with said reduction gear unit output portion terminal end portion, said roll base body (14) including a further annular flange (17) radially seated on the roll base body for rotation therewith, and means (19) projecting inwardly from the milling tube which is connected to said further annular flange.

* * * * *